US005322094A

United States Patent [19]

Janesko

[11] Patent Number: 5,322,094

[45] Date of Patent: Jun. 21, 1994

[54] BOTTLE CAPPING AND PRESSURIZING DEVICE

[76] Inventor: David A. Janesko, 149 Blackhill Rd., Smithfield, Pa. 15478

[21] Appl. No.: 61,081

[22] Filed: May 14, 1993

[51] Int. Cl.[5] ..... B65D 51/24

[52] U.S. Cl. ..... 141/65; 604/227; 215/228; 137/845; 141/64; 141/27

[58] Field of Search ..... 141/63-66, 141/69, 27; 215/228, 260, 309, 312; 53/88; 220/204, 203, 206, 303; 417/234, 554, 545; 137/845; 604/181, 218, 221, 227, 228, 230

[56] References Cited

U.S. PATENT DOCUMENTS

| | | | |
|---|---|---|---|
| 3,016,895 | 1/1962 | Sein | 604/227 X |
| 3,557,986 | 1/1971 | Poole, Jr. | 215/228 |
| 3,602,387 | 8/1971 | Patnaude et al. | 215/228 X |
| 3,672,114 | 6/1972 | Sacks | 53/88 |
| 3,729,032 | 4/1973 | Tischlinger et al. | 141/27 X |
| 4,033,091 | 7/1977 | Saponara . | |
| 4,484,915 | 11/1984 | Tartaglia | 604/227 |
| 4,524,877 | 6/1985 | Saxby et al. . | |
| 4,640,426 | 2/1987 | Wasley . | |
| 4,763,802 | 8/1988 | Johnston | 215/228 |
| 4,763,803 | 8/1988 | Schneider . | |
| 4,768,665 | 9/1988 | Ballas | 215/228 |
| 4,823,968 | 4/1989 | Handzlik | 215/228 |
| 4,842,151 | 6/1989 | Scott . | |
| 4,869,431 | 9/1989 | Jobert et al. | 137/845 X |
| 4,889,250 | 12/1989 | Beyer | 215/228 |
| 4,911,314 | 3/1990 | Schneider | 215/228 |
| 4,998,633 | 3/1991 | Schneider | 215/311 |
| 5,010,928 | 4/1991 | Ballas | 141/64 |
| 5,031,785 | 7/1991 | Lemme | 215/228 |
| 5,032,114 | 7/1991 | Olovsow | 604/228 X |
| 5,059,179 | 10/1991 | Quatrochi | 604/228 X |
| 5,084,017 | 1/1992 | Maffetone | 604/228 X |
| 5,207,339 | 5/1993 | Shyu | 215/228 |

FOREIGN PATENT DOCUMENTS

| | | | |
|---|---|---|---|
| 3400283 | 7/1985 | Fed. Rep. of Germany | 215/228 |

*Primary Examiner*—Ernest G. Cusick
*Attorney, Agent, or Firm*—Rhodes & Ascolillo

[57] ABSTRACT

A bottle capping and pressurizing device for capping and pressurizing a bottle containing an effervescent beverage, the bottle capping and pressurizing device including a housing member, the housing member substantially enclosing a chamber, a piston slidably within the chamber, an attachment apparatus for attaching the housing member to the bottle, the attachment apparatus including a capping surface for covering the mouth of the bottle, a passage leading from the interior of the chamber to the capping surface, and a one way flow valve for transferring air through the passage solely in a direction from the interior of the chamber to the capping surface, the one way flow valve including a flexible diaphragm overlaying the capping surface and at least one slit provided in the flexible diaphragm.

8 Claims, 3 Drawing Sheets

BOTTLE CAPPING AND PRESSURIZING DEVICE

BACKGROUND

1. Field of the Invention

The present invention relates to a device for capping and pressurizing a bottle that contains an effervescent beverage, such as a carbonated soda or a sparkling wine.

2. Description of the Related Art

Carbonated sodas are increasingly being marketed in two and/or three liter bottles, most commonly plastic bottles. This can create a problem, since the beverage tends to go "flat" if the entire contents of the bottle are not consumed soon after opening. The problem is exacerbated with larger size bottles, both since the contents take longer to consume, and since more of an air pocket is created into which the carbonated gases can escape.

U.S. Pat. No. 4,763,803 relates to a stopper for a bottle that is adapted to be used with a pump for evacuating air from the bottle to preserve wine, or for increasing the pressure in the bottle to maintain the carbon dioxide content in a soft drink. A separate pump is required to evacuate air from or compress air into the bottle.

U.S. Pat. No. 4,524,877 relates to a pressurizing and closure apparatus having a hand pump that extends downward that extends downward into the neck of a bottle.

U.S. Pat. No. 4,033,091 relates to a carbonated beverage container closure apparatus to which a bellows type pump is threadingly engaged for introducing compressed air into the container, the bellows type pump then being removed from the closure device.

U.S. Pat. No. 4,842,151 similarly relates to a bellows type pump that is engaged with and disengaged from a bottle closure apparatus. A coupling device is employed to realize the engagement and disengagement function.

Finally, U.S. Pat. No. 4,640,426 relates to a bottle cap for closing and for pressurizing an opened bottle, the bottle cap including a body adapted to close over the mouth of the bottle and a resilient manually compressible and relaxable bulb mounted to the body.

SUMMARY OF THE INVENTION

In one aspect, the invention generally features a bottle capping and pressurizing device for capping and pressurizing a bottle containing an effervescent beverage, the bottle capping and pressurizing device including: a housing member; an attachment apparatus for attaching the housing member to the bottle; a chamber formed within the housing; a passage from the interior of the chamber to the interior of the bottle; a pressurizing apparatus for raising the pressure in the chamber; and a one way flow apparatus for providing flow through the passage solely in a direction from the interior of the chamber to the interior of the bottle, the one way apparatus including a flexible diaphragm and at least one slit provided in the flexible diaphragm.

Preferably, the housing member includes a wall bounding at least a portion of the chamber, the wall having a substantially planar surface exterior of the chamber, the passage includes at least one orifice passing through the wall, and the flexible diaphragm overlays the substantially planar exterior surface; the pressurization apparatus includes a piston disposed within the chamber; the pressurization apparatus additionally includes a plunger member connected to the piston; the pressurization apparatus even further includes a plunger button provided on the plunger member exterior of the chamber; the housing member includes an interior wall at least partially surrounding the chamber, and the piston includes an elastomeric material in sliding contact with the interior wall of the housing member; the bottle capping and pressurizing device additionally includes an X-shaped aperture provided in the housing member, the plunger member being slidably disposed within the X-shaped aperture, and the plunger member having a correspondingly substantially X-shaped cross section; the plunger button includes a plateau extending radially from the plunger member, and the housing member includes a pair of outwardly extending arms, the pair of arms flanking the plunger button, and each of the pair of arms having a concave arcuate lower surface; the at the least one slit provided in the flexible diaphragm includes at least two slits provided in the flexible diaphragm, the at least two slits being aligned transverse to one another; the at least two slits are aligned orthogonally with respect to each another, the bottle capping and pressurizing device additionally includes a spring for biasing the piston in an upward direction; the attachment apparatus includes a threaded female connection; and the bottle capping and pressurizing device further includes an additional one way flow apparatus for providing flow solely in a direction from the exterior of the housing member to the interior of the chamber.

In another aspect, the invention generally features a bottle capping and pressurizing device for capping and pressurizing a bottle containing an effervescent beverage, the bottle capping and pressurizing device including: a housing member; the housing member substantially enclosing a chamber; a piston slidably mounted within the chamber; an attachment apparatus for attaching the housing member to the bottle, the attachment apparatus including a capping surface for covering the mouth of the bottle; a passage loading from the interior of the chamber to the capping surface; and a one way flow valve for transferring air through the passage solely in a direction from the interior of the chamber to the capping surface, the one way flow valve including a flexible diaphragm overlaying the capping surface and at least one slit provided in the flexible diaphragm.

Preferably, the bottle capping and pressurization device additionally includes a spring disposed within the chamber, the spring acting to bias the piston toward its uppermost extent of travel, a pair of arms extending outwardly from the housing member, a plunger member connected to the piston, a plunger button connected to the plunger member and disposed exterior of the chamber, the plunger button being positioned between the pair of arms, each of the pair of arms having a concave arcuate lower surface, and an X-shaped aperture provided in the housing member, the plunger member being X-shaped in cross section and slidingly mounted within the X-shaped aperture; the chamber has a substantially cylindrical periphery, and the piston is substantially circular in shape and includes an elastomeric material in sliding contact with the substantially cylindrical periphery of the chamber; the capping surface is substantially planar, and the at least one slit in the flexible diaphragm includes at least two slits in the flexible diaphragm, the at least two slits in the flexible diaphragm being aligned transversely with respect to one another; the attachment apparatus includes a threaded female connection, and the bottle capping and pressurizing device further includes additional a one way flow apparatus for providing flow solely in a direction from the exterior of the housing member to the interior of the chamber.

In yet another aspect, the invention generally features a bottle capping and pressurizing device for capping and pressurizing a bottle containing an effervescent beverage, the bottle capping and pressurizing device including: a housing member; the housing member having a substantially planar exterior capping surface for covering the mouth of the bottle; an attachment apparatus for attaching the housing member to the bottle, the attachment apparatus including a threaded female connector; a substantially cylindrical chamber formed within the housing member; at least one passage interconnecting the interior of the chamber with the exterior capping surface; a flexible diaphragm overlaying the exterior capping surface; at least one slit provided in the flexible diaphragm; a piston slidingly mounted within the chamber for reciprocation therewithin; the piston including an elastomeric material in contact with the periphery of the substantially cylindrical chamber; a spring disposed within the chamber, the spring acting to bias the piston toward its uppermost extent of travel; an X-shaped aperture passing through the housing member; a plunger member connected to the piston, the plunger member being X-shaped in cross section and being slidably positioned within the X-shaped aperture; a pair of arms extending outward from the housing member, each of the pair of arms having an arcuate concave lower surface; and a plunger button, the plunger button including a radially expanded plateau on the plunger member; and the plunger button being positioned between the pair of arms.

Preferably, the bottle capping and pressurizing device additionally includes a spring for biasing the piston in an upward direction.

One object of the present invention is the provision of a bottle capping and pressurizing device that can be used to cap an opened and partially consumed bottle of an effervescent beverage and that is capable of pressurizing the opened and partially consumed bottle for storage.

Another object of the present invention is the provision of a bottle capping and pressurizing device that is reliable and that can be easily operated by the average individual.

A further object of the invention is the provision of such a bottle capping and pressurizing device that is not disassemblable into various subcomponents that can be lost or mislaid.

The invention will now be described by way of a particularly preferred embodiment, reference being made to the accompanying drawings, wherein:

DESCRIPTION OF THE PREFERRED EMBODIMENT

Figure 1:
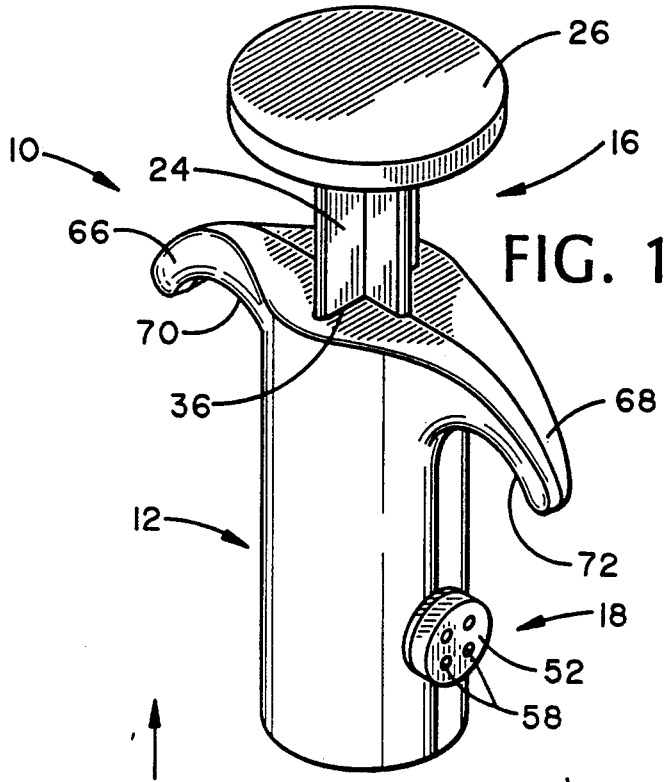
FIG. 1 is a perspective view of a bottle capping and pressurizing device constructed according to the present invention.
Figure 2:
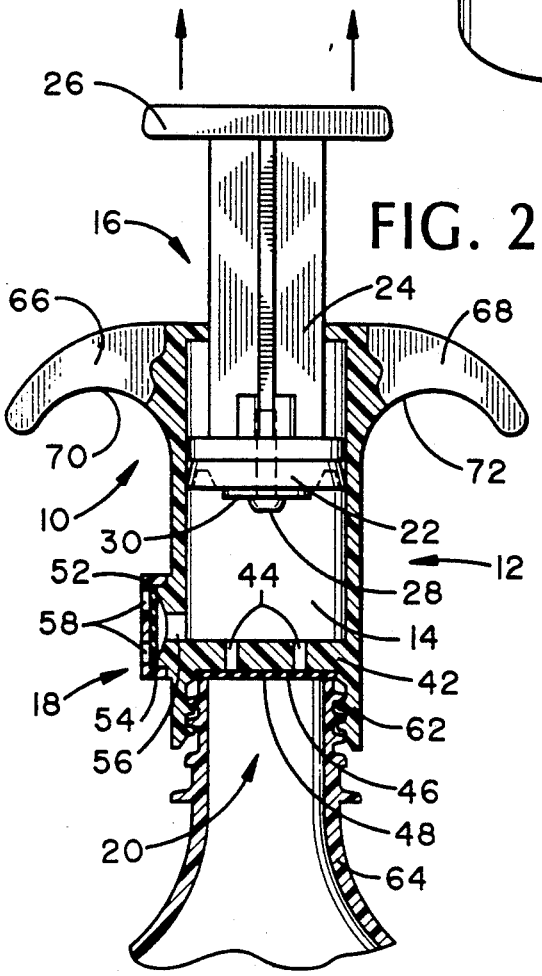
FIG. 2 is a partially sectional elevational view of the inventive bottle capping and pressurizing device, showing a piston and attached plunger member thereof in an upward (or intake) stroke.
Figure 3:
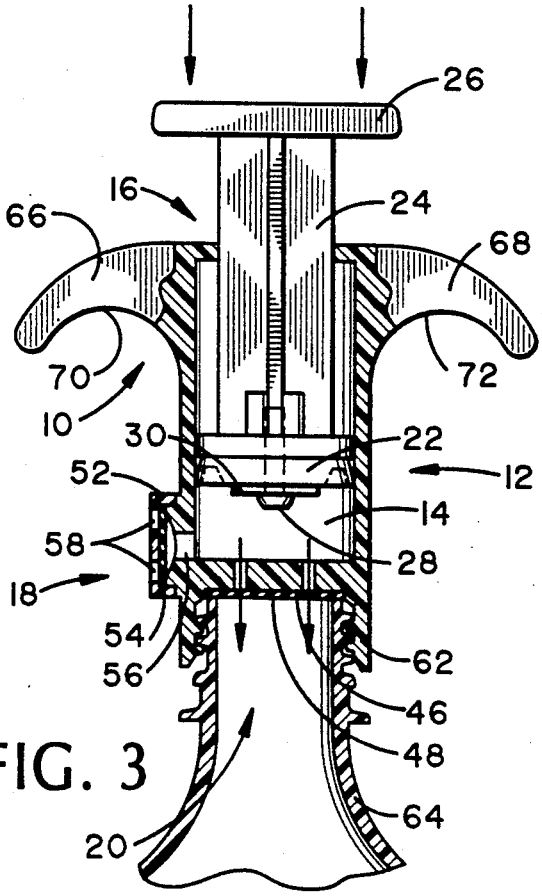
FIG. 3 is a partially sectional elevational view of the bottle capping and pressurizing device, similar to FIG. 2, but showing the piston and attached plunger in a downward (or pressurizing) stroke.

Referring to all of FIGS. 1-5, a bottle capping and pressurizing device 10 constructed according to the invention generally includes a housing 12 that substantially encloses a substantially cylindrical chamber 14 formed within the housing 12, a plunger assembly 16, an intake valve assembly 18, and a pressurization valve assembly 20.

Figure 4:
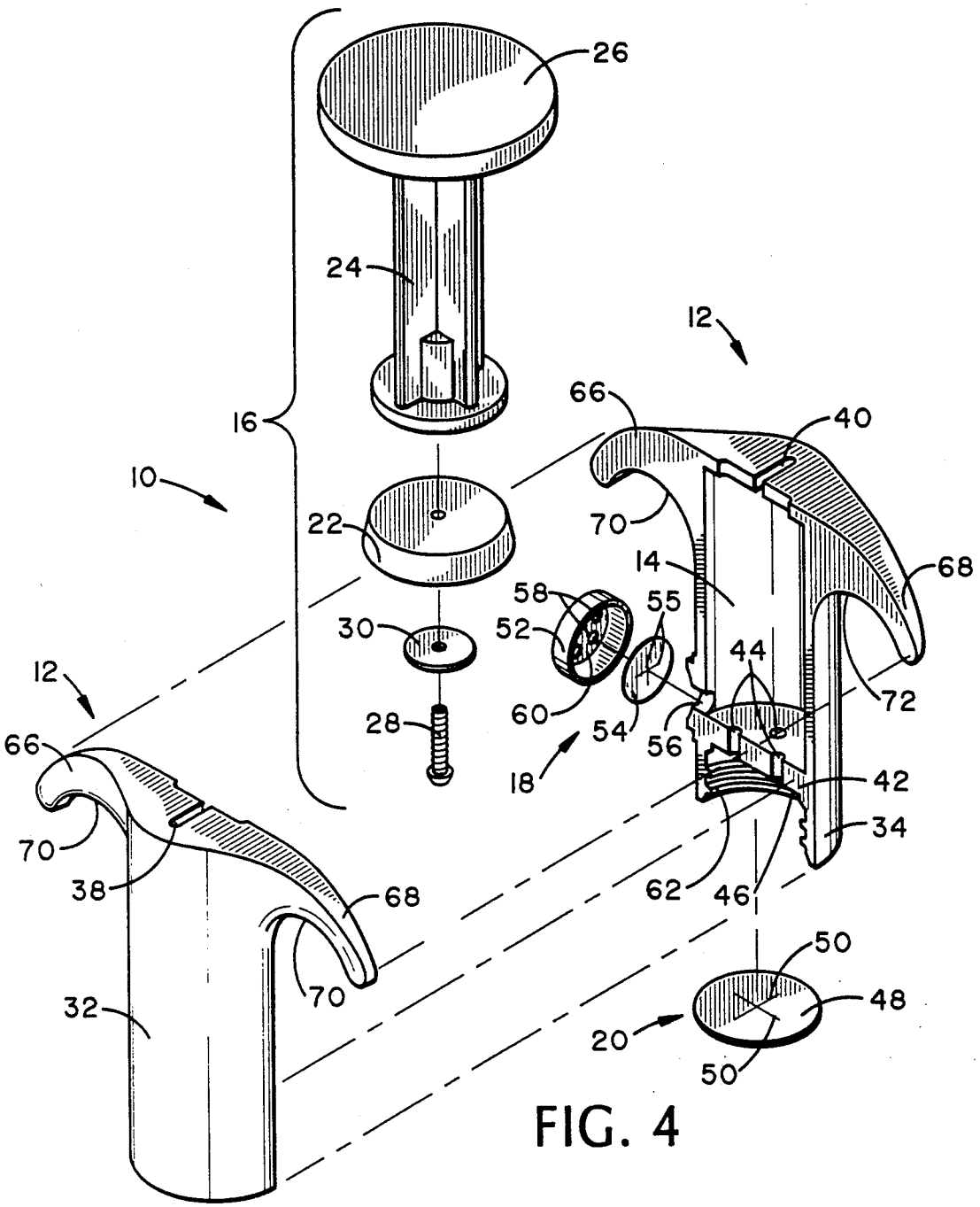
FIG. 4 is an exploded perspective view of the bottle capping and pressurizing device.

Referring now most particularly to FIG. 4, the plunger assembly includes a piston member 22 (preferably formed from a relatively pliable elastomeric material), a plunger member 24, and a plunger button 26 that extends radially from the plunger member 24 and forms a plateau at the top thereof. The plunger button 26 is shaped so as to form a comfortable thumb depressible member. The plunger member 24 and the plunger button 26 are preferably integrally formed as a single unit, and the plunger member 24 preferably has an X-shaped cross section, as shown. The piston member 22 is attached to the integrally formed plunger member 24 and plunger button 26 by a screw 28 and an associated washer 30.

The housing member 12 is preferably formed of two housing components 32 and 34, each housing component 32 and 34 forming substantially one half of the housing member 12. Preferably, the two housing components 32 and 34 are constructed from a relatively rigid plastic material. The housing member 12 is provided with an X-shaped aperture 36 in the upper portion thereof that serves as a slidable bearing surface for the corresponding X-shaped plunger member 24. As is shown most clearly in FIG. 4, the two housing components 32 and 34 are each provided with a half aperture 38 and 40, respectively, that form the aperture 36 when housing components 32 and 34 are mated to one another.

A wall 42 is formed at the bottom of the housing member 12 such that the wall 42 bounds the chamber 14 at its lowermost extent. The wall 42 is provided with at least one, and preferably four, throughgoing orifices 44 that interconnect the interior of the chamber 14 with the exterior surface 46 of the wall 42. Preferably, the exterior surface 46 of the wall 42 is substantially planar, and the exterior surface 46, the orifices 44, and a flexible diaphragm 48, which is provided with a pair of slits 50 therein constitute a one way flow valve, namely, the pressurization valve 20. Air that is forced downward through the orifices 44 during a pressurization stroke, when the pressure in the chamber 14 exceeds the pressure on the bottom surface of the flexible diaphragm 48 (i.e., the pressure in the bottle), passes freely through the slits 50, inasmuch as the flexible diaphragm 48 is able to billow away from the wall 42. However, following a pressurization stroke, the return of air upwards through the orifices 44 is prevented, since a greater air pressure on the bottom surface of the flexible diaphragm 48 than in the chamber 14 keeps the flexible diaphragm 48 sealed flush against the exterior surface 46 of wall 42.

The intake valve 18 is similar in construction and operation to the pressurization valve 20 described above. In this regard, the intake valve 18 functions as another one way flow valve and includes a cap member 52, an additional diaphragm 54 positioned within the cap member 52, the additional diaphragm 54 being provided with a pair of slits 55 positioned at right angles to one another, and an additional orifice 56 provided through the housing member 12. The cap member 52 has four throughgoing orifices 58 and an interior surface 60, shown most clearly in FIG. 4, that functions similarly to the exterior surface 46 of the pressurization valve 20, in that air can pass freely through the orifices 58 and into the chamber 14 during an intake stroke, but an elevated pressure in the chamber 14, during a pressurization stroke, keeps the additional diaphragm 54 flush against the surface 60.

The bottle capping and pressurizing device 10 is also provided with a threaded female connection 62 that surrounds the exterior surface 46 of the wall 42, permitting attachment of the device 10 to a bottle 64.

Finally, in order to provide for a comfortable grip while using the device 10, the housing member 12 is preferably provided with a pair of outwardly extending arms 66 and 68 that flank the plunger button 26. Each of the arms 66 and 68 is preferably provided with an arcuate concave lower surface 70 and 72, respectively, to provide comfortable finger grips that act in opposition to the plunger button 26.

Figure 5:
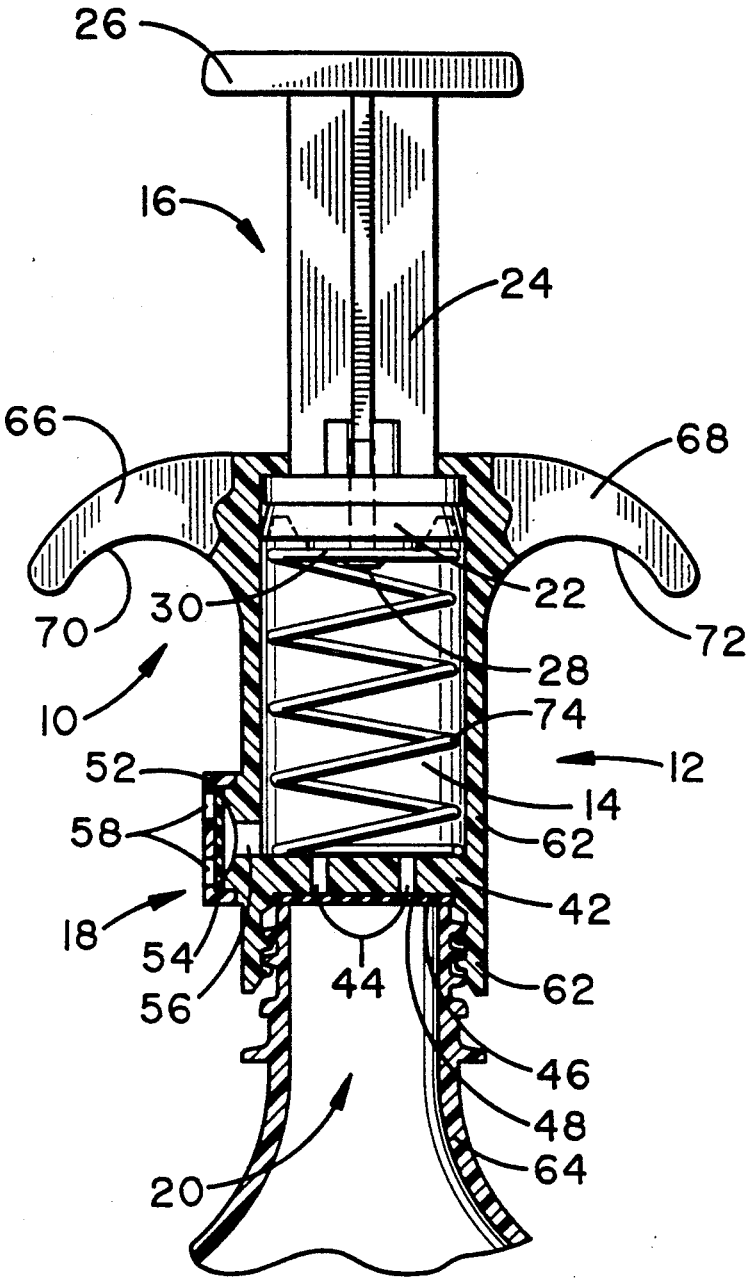
FIG. 5 is a partially sectional elevational view of an alternative embodiment of the bottle capping and pressurizing device, showing an optional biasing spring employed therein.

FIG. 5 illustrates an alternative embodiment of the invention, wherein a spring 74 is positioned within the chamber 14, the spring 74 providing a biasing action to bias the plunger assembly 16 towards its uppermost extent of travel.

While the invention has been herein described by way of a particular preferred embodiment, various substitutions of equivalents may be effected without departing from the spirit and scope of the invention as set forth in the following claims.

What is claimed is:

1. A bottle capping and pressurizing device for capping and pressurizing a bottle containing an effervescent beverage, said bottle capping and pressurizing device comprising:

a housing member having a bottom wall and a side wall;

attachment means for attaching said housing member to the bottle;

a chamber formed within said housing;

a passage leading from the interior of said chamber to the interior of the bottle;

pressurization means for raising the pressure in said chamber comprising:

a piston disposed within said chamber, a plunger member connected to said piston;

a plunger button provided on said plunger member exterior of said chamber;

one way flow means for providing flow through said passage solely in a direction form said interior of said chamber to the interior of the bottle, said one way flow means comprising a flexible diaphragm and at least one slit provided in said flexible diaphragm, an adjacent exterior surface of said bottom wall of said housing member which abuts said flexible diaphragm and substantially prevents said flexible diaphragm from flexing toward said interior of said chamber beyond said adjacent exterior surface, thereby substantially preventing flow through said at least one slit, said bottom wall being provided with at least one orifice passing through said bottom wall; and an X-shaped aperture provided in said housing member, said plunger member being slidingly disposed within said X-shaped aperture, and said plunger member having a correspondingly substantially X-shaped cross section.

2. A bottle capping and pressurizing device according to claim 1 wherein said housing member comprises an interior wall at least partially surrounding said chamber, and wherein said piston comprises an elastomeric material in sliding contact with said interior wall of said housing member.

3. A bottle capping and pressurizing device according to claim 2, wherein said plunger button comprises a plateau extending radially from said plunger member, and wherein said housing member comprises a pair of outwardly extending arms, said pair of arms flanking said plunger button, and each of said pair of arms having a concave arcuate lower surface.

4. A bottle capping and pressurizing device according to claim 2 wherein said at least one slit provided in said flexible diaphragm comprises at least two slits provided in said flexible diaphragm, said at least two slits being aligned transverse to one another, and said adjacent exterior surface of said bottom wall of said housing member abutting said flexible diaphragm, substantially preventing flow through said at least two slits.

5. A bottle capping and pressurizing device according to claim 4 wherein said at least two slits are aligned orthogonally with respect to one another, and said adjacent exterior surface of said bottom wall of said housing member substantially preventing flow through said orthogonally aligned at least two slits.

6. A bottle capping and pressurizing device according to claim 5, said bottle capping and pressurizing device additionally comprising a spring for biasing said piston in an upward direction.

7. A bottle capping and pressurizing device according to claim 6, wherein said attachment means comprises a threaded female connection.

8. A bottle capping and pressurizing device according to claim 5, said bottle capping and pressurizing device further comprising additional one way flow means for providing flow solely in a direction from the exterior of said housing member to the interior of said chamber, said additional one way flow means comprising a flexible diaphragm, at least one slit provided in said flexible diaphragm, and an adjacent exterior surface of a lower portion of said side wall of said housing member which abuts said flexible diaphragm and substantially prevents said flexible diaphragm from flexing toward the interior of said chamber beyond said adjacent exterior surface of the lower portion of said side wall, thereby substantially preventing flow through said at least one slit, said lower portion of said side wall being provided with at least one orifice passing through said side wall.

* * * * *